US006640718B2

(12) United States Patent
Duguet et al.

(10) Patent No.: US 6,640,718 B2
(45) Date of Patent: Nov. 4, 2003

(54) THIN-FILM BRIDGE ELECTROPYROTECHNIC INITIATOR WITH A VERY LOW OPERATING ENERGY

(75) Inventors: Jean-René Duguet, Survilliers (FR); Jean-Pierre Vedel, Survilliers (FR)

(73) Assignee: Livbag S.N.C. Centre de Recherches du Bouchet, Vert le Petit (FR)

( * ) Notice: Subject to any disclaimer, the term of this patent is extended or adjusted under 35 U.S.C. 154(b) by 0 days.

(21) Appl. No.: 09/846,285

(22) Filed: May 2, 2001

(65) Prior Publication Data

US 2002/0002924 A1 Jan. 10, 2002

(30) Foreign Application Priority Data

May 30, 2000 (FR) ..... 00 06926

(51) Int. Cl.[7] ..... F42B 3/10
(52) U.S. Cl. ..... 102/202.5
(58) Field of Search ..... 102/202.5, 202.14

(56) References Cited

U.S. PATENT DOCUMENTS

| | | | | | |
|---|---|---|---|---|---|
| 3,572,247 | A | | 3/1971 | T. Warshall | |
| 4,729,315 | A | | 3/1988 | Proffit et al. | |
| 5,140,906 | A | * | 8/1992 | Little, II | 102/202.14 |
| 5,254,838 | A | * | 10/1993 | Hasegawa et al. | 123/145 A |
| 5,345,872 | A | * | 9/1994 | Takahashi et al. | 102/202.14 |
| 5,353,707 | A | * | 10/1994 | Duguet | 102/290 |
| 5,544,585 | A | * | 8/1996 | Duguet | 102/202.5 |
| 5,576,509 | A | * | 11/1996 | Refouvelet et al. | 102/202.14 |
| 5,596,163 | A | * | 1/1997 | Caflisch et al. | 102/202.14 |
| 5,736,668 | A | * | 4/1998 | Fogle et al. | 102/202.5 |
| 5,798,476 | A | | 8/1998 | Bailey | |
| 5,932,832 | A | * | 8/1999 | Hansen et al. | 102/202.2 |
| 6,220,163 | B1 | * | 4/2001 | Duguet et al. | 102/200 |
| 6,289,813 | B1 | | 9/2001 | Duguet et al. | 102/202.5 |
| 6,408,758 | B1 | | 6/2002 | Duguet | 102/202.2 |

FOREIGN PATENT DOCUMENTS

| | | |
|---|---|---|
| DE | 197 32 380 | 2/1999 |
| FR | 2 781 878 | 2/2000 |
| WO | WO 96/24024 | 8/1996 |
| WO | WO 98/25100 | 6/1998 |
| WO | WO 98/28792 | 7/1998 |

* cited by examiner

*Primary Examiner*—Charles T. Jordan
*Assistant Examiner*—Jordan M Lofdahl
(74) *Attorney, Agent, or Firm*—Pillsbury Winthrop LLP

(57) ABSTRACT

The present invention relates to the field of very low-energy electropyrotechnic initiators.

The initiator (1) according to the invention comprises, in particular:

an electrically and thermally insulating support (26) on which is deposited a thin-film electrical circuit comprising a resistive heating element (17) whose thickness is less than $1\times10^{-6}$ m;

an ignition composition (23) consisting of a primary explosive, the particle size of which is less than $30\times10^{-6}$ m.

The initiators according to the invention are very suitable for initiating devices for protecting the occupants of a motor vehicle.

9 Claims, 2 Drawing Sheets

THIN-FILM BRIDGE ELECTROPYROTECHNIC INITIATOR WITH A VERY LOW OPERATING ENERGY

The present invention relates to the field of electropyrotechnic initiators intended, in particular, to initiate devices for protecting the occupants of a motor vehicle, such as for example seat belt retractors or gas generators that have to inflate airbags. More specifically, the invention relates to an electropyrotechnic initiator, the resistive heating element of which consists of a thin-film bridge and which operates with very low energy.

Conventionally, electropyrotechnic initiators intended for motor-vehicle safety consist of an electrically insulating body extended by a fragmentable metal cap and penetrated by two electrodes. The electrodes are joined together via a suspended resistive heating filament surrounded by an explosive ignition composition made of a primary explosive or of an oxidation-reduction mixture as described for example in U.S. Pat. No. 3,572,247. However, such initiators have the drawback of being sensitive to the vibrations of the motor vehicle at the soldered joints between the resistive filament and the electrodes. These soldered joints, when repeatedly stressed by the vibrations of the vehicle, may fracture and make the initiator inoperable, which means that this technology is presently being progressively phased out.

To remedy this drawback, a new type of initiator has therefore been developed in which the electrodes are connected to two separate conducting metal areas extended over the surface of the insulating body, which is inside the metal cap, and a resistive heating element is placed between these two areas.

In this new type, two large families may be distinguished depending on the thickness of the resistive heating element:

firstly, initiators whose conducting areas and resistive strip consist of printed circuits or of photoetched "thick film" foils, the thickness of which is greater than $2\times10^{-6}$ m and often between $2\times10^{-6}$ m and $7\times10^{-6}$ m, or alternatively between 2 and 7 micrometers. Such initiators are, for example, described in the U.S. Pat. No. 5,544,585. Such initiators exhibit good resistance to the vibrations of the motor vehicle but require, like filament initiators, relatively high energy to operate;

secondly, initiators whose resistive strip consists of a "thin film" coating whose thickness is less than or equal to $1\times10^{-6}$, or alternatively 1 micrometer, and which is deposited by vacuum evaporation on its support. Such initiators are described, for example, in the U.S. Pat. No. 5,798,476 or the U.S. Pat. No. 4,729,315. These initiators exhibit good resistance to the vibrations of the motor vehicle and have, in addition, the advantage of having a no-fire current of at least 400 mA with an all-fire current close to 1200 mA, which is increasingly demanded by motor manufacturers and which is not offered by filament initiators or "thick film" initiators.

The reader is reminded in this regard that:

the "all fire" current corresponds to the limiting intensity of an electric current above which it is certain that all the igniters of a batch will operate;

the "no-fire" current corresponds to the limiting intensity of an electric current below which it is certain that no igniter of a batch will operate.

However, because of the fact that known thin films are generally deposited on thermally conducting supports, these initiators also have the drawback of requiring a relatively high operating energy.

Faced with the increasing number of safety devices inside motor vehicles, manufacturers increasingly desire to be able to have reliable initiators operating at very low energy.

It is an object of the present invention specifically to provide such an initiator.

The invention therefore relates to an electropyrotechnic initiator comprising:

i) a container having at least one weekend wall and being closed by a solid body of height h having a plane upper face placed inside the container and having, over its entire height h, an electrically insulating structure;

ii) two electrodes in the form of pins which pass completely through the said solid body, at least one of the two electrodes passing through the said insulating structure;

iii) an electrical circuit consisting of thin films deposited on a support which is electrically non-conducting and is attached to the said plane upper face, the said electrical circuit being connected to the said electrodes and comprising a thin-film resistive heating element, the said circuit being covered by a pyrotechnic ignition composition;

characterized in that:

iv) the said support has a thermal conductivity of less than 20 mW/cm.° C.;

v) the said resistive heating element has a thickness of less than $1\times10^{-6}$ m; and vi) the said pyrotechnic ignition composition consists of a binder and of a primary explosive, the particle size of which is between $1\times10^{-6}$ m and $30\times10^{-6}$ m.

Thus, using as resistive element a thin-film deposited on a support which is both an electrical insulator and a very poor thermal conductor, and by imposing particular conditions on the particle size of the primary explosive present in the ignition composition, it is possible to form an electropyrotechnic initiator which operates reliably with a very low energy, of the order of a few hundred microjoules, and which, when the constituent elements are properly dimensioned, has all-fire and no-fire currents which are compatible with the new requirements of motor-vehicle manufacturers.

The said electrical circuit and the said support will advantageously consist of an SMD (Surface Mount Device) component mounted on the surface of the solid body.

According to a preferred embodiment of the invention, an electrically non-conducting spacer having two opposed plane faces is adhesively bonded via one of its plane faces to the plane upper face of the said solid body and in the other plane face of the spacer has two separate conducting metal areas which are each in contact with one of the two electrodes and to which the SMD component is attracted by means of two electrically conducting brazes.

This embodiment allows particularly easy assembly of the initiator according to the invention, as will be explained in detail further on in the description.

Finally, according to another preferred embodiment of the invention, the said container and the said solid body are kept fastened together by an electrically non-conducting overmoulding, through which the two electrodes pass.

Advantageously, the support will be made of a material chosen from the group consisting of vitreous silica, mineral glasses containing silica, organic resins, and composite plastics containing at least one organic resin and mineral fibres. Preferably, the said support is made of a material chosen from the group consisting of mineral glasses containing silica.

Within the context of the present invention, the various primary explosives lending themselves to the abovementioned particle size condition can be used, but it will be preferred, for reasons of operating reliability, to use salts of dinitrobenzofuroxan and especially the rubidium salt of dinitrobenzofuroxan (RbDNBF) and the potassium salt of dinitrobenzofuroxan (KDNBF). The binder of the ignition composition will advantageously consist of a vinyl or acrylic resin. As regards the said flat resistive element, this will advantageously be made of tantalum nitride.

A detailed description of a preferred embodiment of the invention will be given below with reference to FIGS. 1, 2 and 3.

Figure 1:
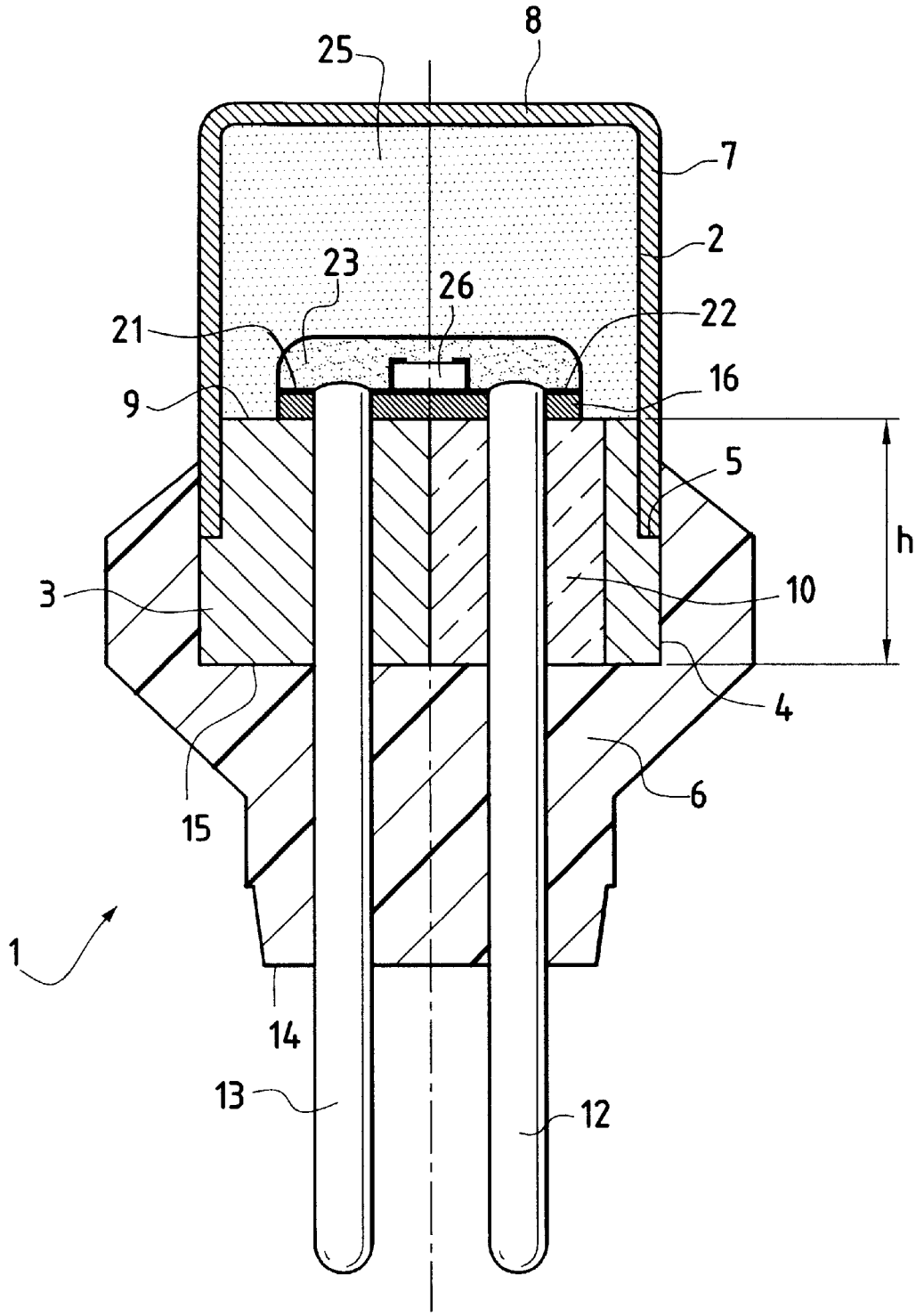
FIG. 1 is an axial sectional view of a cylindrical initiator according to the invention.

An electropyrotechnic initiator 1 according to the invention is shown in FIG. 1. This initiator 1 consists of a fragmentable cylindrical container 2 open at one of its ends. A solid cylindrical body 3 closes the open end of the container 2. The side wall 4 of the body 3 has an external shoulder 5 on which the open end of the container 2 bears. The container 2 and the body 3 are gripped in an overmoulding 6 which holds them together. The container 2 thus has the shape of a cylindrical cap having a side wall 7 and a plane upper wall 8. Advantageously, the container 2 consists of a thin light metal such as aluminium and its plane wall 8 is advantageously weakened in order to be able to easily open under the effect of an increase in the pressure within the container. The overmoulding 6 is preferably made in a thermoplastic resin such as, for example, polyethylene terephthalate.

The body 3 must be able to function as a wall impermeable to a detonation and to the combustion gases resulting from this detonation. This body 3 is preferably made in a dense metal such as steel. The body 3 has a plane upper face 9 and a lower, also plane, face 15 and it grips, over its entire height h, a hollow glass tube 10. Two electrodes 12, 13 in the form of cylindrical pins pass through the body 3, the electrode 12 passing through it via the hollow glass tube 10.

Each electrode has an end which projects from the plane upper face 9 of the body 3 and an end which projects from the lower face 14 of the overmoulding 6. Fastened to the plane upper face 9 of the body 3, for example by adhesive bonding, is an insulating spacer 16 which is thus placed inside the container 2.

The spacer 16 is based on a polyepoxy resin filled with glass fibres and has the shape of a disc with two cylindrical channels intended to allow, during assembly of the initiator 1, the electrodes 12 and 13 to pass through it.

The spacer 16 has, on its upper face, two separate and non-touching metal areas 21 and 22 made of copper; the upper ends of the electrodes 12 and 13 are each connected to one of the areas 21 and 22 by means of soldered joints 27 and 28 made from an electrically conducting alloy.

Figure 2:
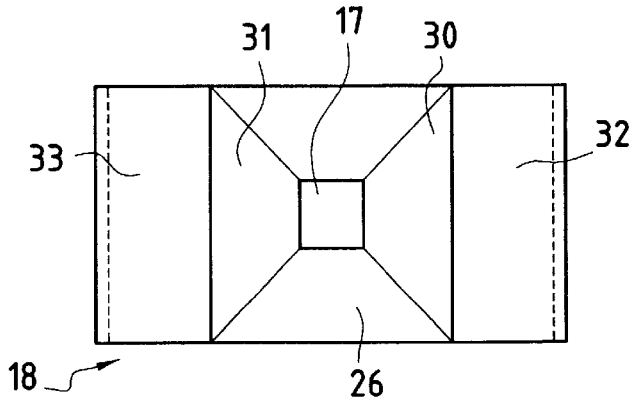
FIG. 2 is a top view of the electrical circuit produced by thin-film deposition, used in the initiator shown in FIG. 1.
Figure 3:
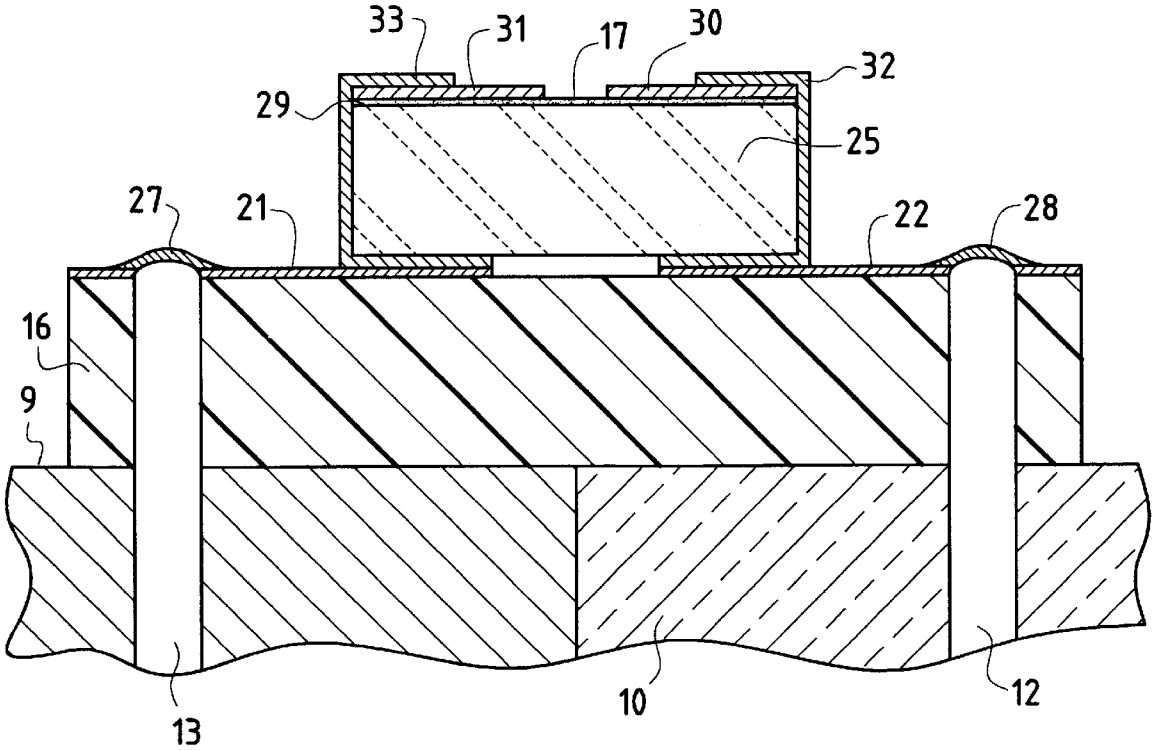
FIG. 3 is a partial sectional view of the solid body carrying the spacer and the SMD component, such as those used in the initiator shown in FIG. 1.

Fastened across these two areas 21 and 22 is an SMD component consisting of a support 26 in the form of a parallelepipedal chip, the upper face of which carries an electrical circuit 18. The support 26 is made of an ordinary flint glass containing between 20% and 50% silica $SiO_2$. Such a glass is an excellent electrical insulator and a very poor thermal conductor, its thermal conductivity being about 6 mW/cm° C. The circuit 18 is formed by a thin film 29 of tantalum nitride partially covered with thin films 30 and 31 of conducting metals based on gold and palladium. As shown in FIG. 2, the films 29, 30 and 31 have trapezoidal shapes which leave a central parallelepipedal region 17 of the tantalum nitride coating 29 uncovered. This region 17 constitutes the thin-film resistive heating element of the electrical circuit 18. A tin solder joint 32 grips one of the ends of the support 26 so as to ensure electrical connection between the conducting film 30 and the conducting area 22, while a separate solder joint 33, also made of tin, grips the opposite end of the support 26 so as to ensure electrical connection between the conducting film 31 and the conducting area 21.

The electrical circuit 18 comprising the resistive heating element 17 is covered by a pyrotechnic ignition composition 23 consisting, in the case of 80% of its weight, of the rubidium salt of dinitrobenzofuroxan and in the case of 20% of its weight of an epoxy resin acting as binder. The particle size of the RbDNBF primary explosive is about $20\times10^{-6}$ m.

The container 2 also contains an ignition powder 25 consisting, for example, of a powder based on nitrocellulose or of a blend of potassium nitrate and boron.

Such an initiator is particularly simple and inexpensive to mass produce. The manufacturer starts by depositing, by vacuum evaporation, the thin-film circuit 18 on its support 26. Next, the electrodes 12 and 13 are fastened to the spacer 16 covered by the areas 21 and 22 to which the support 26 is soldered. The spacer 16 thus furnished is adhesively bonded to the plane upper face 9 of the solid body 3 so as to constitute an initiation head which is covered by the ignition composition 23 before it is introduced into the container 2 containing the ignition powder 25. All that is then required is to consolidate the assembly by means of the overmoulding 6.

The initiators according to the invention can operate reliably with very low energy, of about 100 to 200 microjoules, or alternatively $1\times10^{-4}$ to $2\times10^{-4}$ J, and when their constituent elements, and especially the resistive element 17, are properly dimensioned they have all-fire current values of 1200 mA and no-fire current values greater than 500 mA. Moreover, since the thin-film initiators have good vibration resistance, the initiators according to the invention find preferred application in the field of the protection of motor-vehicle occupants by electropyrotechnic devices.

EXAMPLES 1 TO 4

Four groups of initiators with a structure similar to that shown in FIGS. 1 and 2 and having the following structural characteristics were manufactured:

| Group | Resistive element 17 | Ignition composition | Nature of the support 26 |
|---|---|---|---|
| 1 | nickel/chromium thickness: 25 microns | oxidation-reduction mixture | epoxy resin |
| 2 | nickel/chromium thickness: 5 microns | lead trinitro-resorcinate + vinyl resin | epoxy resin |
| 3 | tantalum nitride thickness: 1 micron | lead trinitro-resorcinate + vinyl resin | alumina |

-continued

| Group | Resistive element 17 | Ignition composition | Nature of the support 26 |
|---|---|---|---|
| 4 | tantalum nitride thickness: 0.5 microns | RbDNBF having a particle size close to 20 microns + vinyl resin | flint glass |

Reminder: 1 micron = 1 micrometer = $10^{-6}$ m.

Initiator No. 1 corresponds to a thick-film bridge initiator on a thermally non-conducting support and an ignition composition using an oxidation-reduction mixture.

Initiator No. 2 corresponds to a thick-film bridge initiator on a thermally non-conducting support and an ignition composition using a primary explosive.

Initiator No. 3 corresponds to a thin-film bridge initiator on a thermally conducting support and with an ignition composition using a primary explosive.

Initiator No. 4 combines the three essential characteristics of the invention:

thin-film bridge;

thermally non-conducting support;

primary explosive having a particle size of less than 30 microns.

These initiators have the following operating characteristics:

| Group No. | "No-fire" current (1) | "All-fire" current (2) | Energy |
|---|---|---|---|
| 1 | 300 mA | 1750 mA | 5 mJ |
| 2 | 250 mA | 1200 mA | 5 mJ |
| 3 | 500 mA | 1200 mA | 3.5 mJ |
| 4 | 600 mA | 1100 mA | 0.200 mJ |

mA = milliampere = $10^{-3}$ A
mJ = millijoule = $10^{-3}$ J
(1)for rectangular electrical pulses of 10 seconds' duration;
(2)for rectangular electrical pulses of 2 milliseconds' duration.

What is claimed is:

1. Electropyrotechnic initiator (1) comprising:

i) a container (2) having at least one weakened wall (8) and being closed by a solid body (3) of height h having a plane upper face (9) placed its entire height h, an electrically insulating structure (10);

ii) two electrodes (12, 13) in the form of pins which pass completely through the said solid body, at least one of the two electrodes passing through the said insulating structure (10);

iii) an electrical circuit (18) consisting of thin films deposited on a support (26) which is electrically non-conducting and is attached to the said plane upper face (9), the said electrical circuit being connected to the said electrodes (12, 13) and comprising a thin-film resistive heating element (17), the said circuit being covered by a pyrotechnic ignition composition (23);

characterized in that:

iv) the said support (26) has a thermal conductivity of less than 20 mW/cm. ° C.;

v) the said resistive heating element (17) has a thickness of less than $1\times10^{-6}$ m; and vi) the said pyrotechnic ignition composition (23) consists of a binder and of a primary explosive, the particle size of which is between $1\times6^{-6}$ m and $30\times10^{-6}$ m.

2. Electropyrotechnic initiator according to claim 1, characterized in that the said electrical circuit (18) and the said support (26) consist of an SMD component surface-mounted on the solid body (3).

3. Electropyrotechnic initiator according to claim 2, characterized in that an electrically non-conducting spacer (16) having two opposed plane faces is adhesively bonded via one of its plane faces to the plane upper face (9) of the body (3) and in that the other plane face of the spacer (16) has two separate conducting metal areas (21, 22) which are each in contact with one of the two electrodes and to which the SMD component is attached by means of two electrically conducting soldered joints.

4. Electropyrotechnic initiator according to claim 1, characterized in that the said container (2) and the said solid body (3) are kept fastened together by an electrically non-conducting overmoulding (6).

5. Electropyrotechnic initiator according to claim 1, characterized in that the said support is made of a material chosen from the group consisting of vitreous silica, mineral glasses containing silica, organic resins, and composite plastics containing at least one organic resin and mineral fibres.

6. Electropyrotechnic initiator according to claim 5, characterized in that the said support is made of a material chosen from the group consisting of mineral glasses containing silica.

7. Electropyrotechnic initiator according to claim 1, characterized in that the said primary explosive is a salt of dinitrobenzofuroxan.

8. Electropyrotechnic initiator according to claim 7, characterized in that the said primary explosive is chosen from the group consisting of the rubidium salt of dinitrobenzofuroxan (RbDNBF) and the potassium salt of dinitrobenzofuroxan (KDNBF).

9. Electropyrotechnic initiator according to claim 1, characterized in that the said flat resistive element is made of tantalum nitride.

* * * * *

UNITED STATES PATENT AND TRADEMARK OFFICE

CERTIFICATE OF CORRECTION

PATENT NO. : 6,640,718 B2
DATED : November 4, 2003
INVENTOR(S) : Jean-René Duguet et al.

It is certified that error appears in the above-identified patent and that said Letters Patent is hereby corrected as shown below:

Column 2,
Line 52, change “attracted” to -- attached --.

Column 5,
Line 47, after “placed” insert -- inside the container (2) and having, over” --.

Column 6,
Line 14, change “$1x6^{-6}$” to -- $1x10^{-6}$ --.

Signed and Sealed this

Twenty-ninth Day of June, 2004

JON W. DUDAS
*Acting Director of the United States Patent and Trademark Office*